US009589744B2

(12) United States Patent
Aeschbach et al.

(10) Patent No.: US 9,589,744 B2
(45) Date of Patent: Mar. 7, 2017

(54) SPRING CONTROL DEVICE FOR A CIRCUIT BREAKER

(71) Applicant: ALSTOM TECHNOLOGY LTD, Baden (CH)

(72) Inventors: Heinz Aeschbach, Reinach (CH); Simon Ardyna, Habsheim (FR); Jean-Pierre Dupraz, Bressolles (FR); David Berard, Villeurbanne (FR)

(73) Assignee: ALSTOM TECHNOLOGY LTD, Baden (CH)

( * ) Notice: Subject to any disclaimer, the term of this patent is extended or adjusted under 35 U.S.C. 154(b) by 0 days.

(21) Appl. No.: 14/443,283

(22) PCT Filed: Nov. 20, 2013

(86) PCT No.: PCT/EP2013/074274
§ 371 (c)(1),
(2) Date: May 15, 2015

(87) PCT Pub. No.: WO2014/079877
PCT Pub. Date: May 30, 2014

(65) Prior Publication Data

US 2015/0348718 A1 Dec. 3, 2015

(30) Foreign Application Priority Data

Nov. 21, 2012 (FR) ..... 12 61083

(51) Int. Cl.
*H01H 5/00* (2006.01)
*H01H 3/46* (2006.01)
(Continued)

(52) U.S. Cl.
CPC ..... *H01H 3/46* (2013.01); *H01H 3/30* (2013.01); *H01H 3/3015* (2013.01); *H01H 3/38* (2013.01);
(Continued)

(58) Field of Classification Search
CPC H01H 5/04; H01H 5/045; H01H 5/18; H01H 5/20
(Continued)

(56) References Cited

U.S. PATENT DOCUMENTS 4,123,638 A * 10/1978 Miyamoto ..... H01H 5/04 200/257
4,402,033 A 8/1983 Mayer
(Continued)

FOREIGN PATENT DOCUMENTS

| | | | |
|---|---|---|---|
| BE | 662849 | A | 8/1965 |
| JP | S57170427 | A | 10/1982 |
| JP | H0877860 | A | 3/1996 |

OTHER PUBLICATIONS

International Search Report and Written Opinion for PCT Application No. PCT/EP2013/074274 dated Dec. 20, 2013.
(Continued)

*Primary Examiner* — Vanessa Girardi
(74) *Attorney, Agent, or Firm* — Nixon Peabody, LLP; Khaled Shami

(57) ABSTRACT

For application to medium- and high-voltage circuit breakers, the control device makes it possible to actuate opening of the circuit breakers used in the medium- and high-voltage networks very quickly. The spring used in the control device is a spring of the composite type, having a curved C- or Ω-shape. The spring has a stationary first end and a movable second end that is pivotally connected to the end of a lever device, that is itself constrained to rotate with the drive shaft of the control device.

2 Claims, 1 Drawing Sheet

Figure 1:
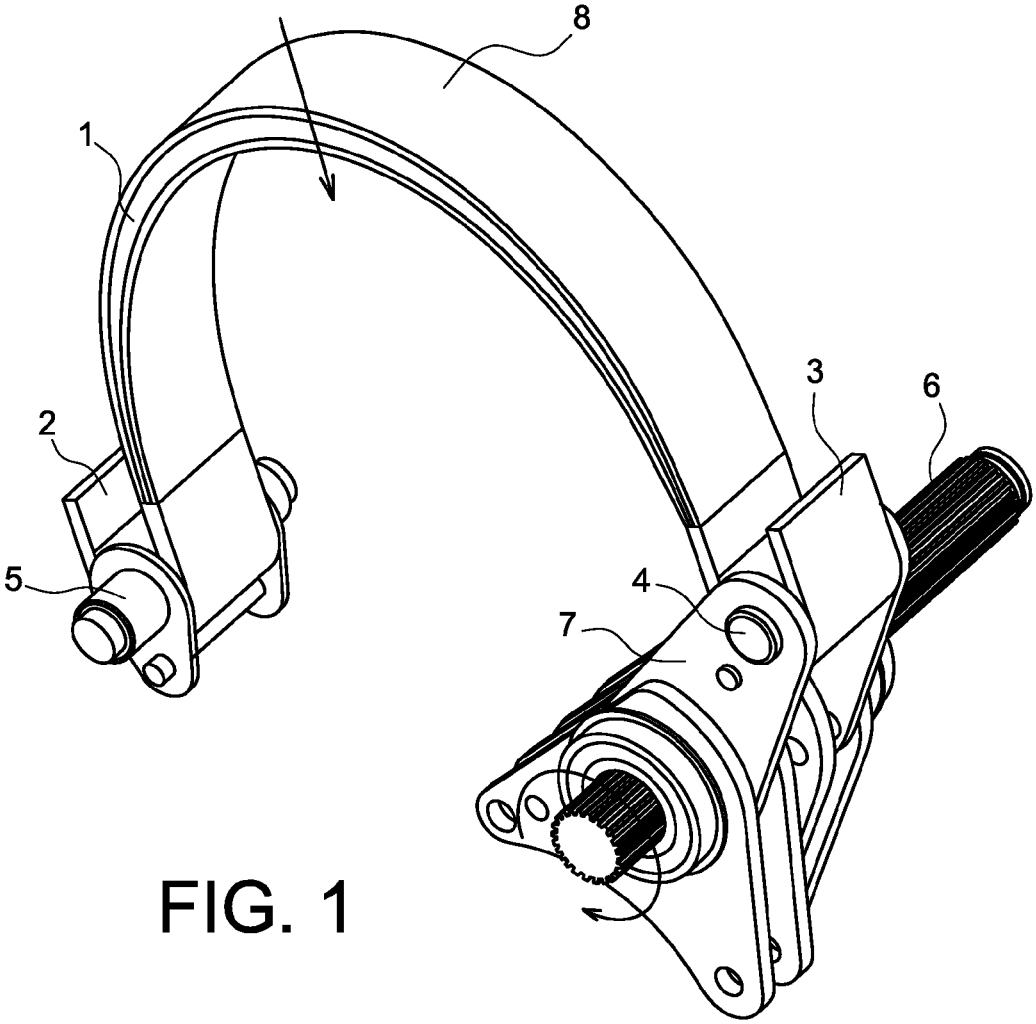

(51) Int. Cl.

| | |
|---|---|
| ***H01H 3/30*** | (2006.01) |
| ***H01H 9/02*** | (2006.01) |
| ***H01H 3/38*** | (2006.01) |
| ***H01H 71/10*** | (2006.01) |

(52) U.S. Cl.
CPC ..... *H01H 9/02* (2013.01); *H01H 71/10* (2013.01); *H01H 2235/018* (2013.01)

(58) Field of Classification Search
USPC ..... 200/400; 335/171
See application file for complete search history.

(56) References Cited

U.S. PATENT DOCUMENTS

| | | | | |
|---|---|---|---|---|
| 5,428,329 | A * | 6/1995 | Grunert | H01H 71/504 335/167 |
| 9,275,811 | B2 * | 3/2016 | Naiman | H01H 21/22 |
| 2002/0046940 | A1 * | 4/2002 | Bruckert | H01H 71/526 200/400 |
| 2004/0027776 | A1 | 2/2004 | Uotome et al. | |

OTHER PUBLICATIONS

French Preliminary Search Report for FR 1261083 dated Jun. 26, 2013.
Office Action dated Oct. 21, 2016, U.S. Appl. No. 14/394,732, 16 pages.

* cited by examiner

SPRING CONTROL DEVICE FOR A CIRCUIT BREAKER

CROSS-REFERENCE TO RELATED PATENT APPLICATION

The present application is a National Stage Application of International Application No. PCT/EP2013/074274 entitled "SPRING CONTROL DEVICE FOR A CIRCUIT BREAKER" filed Nov. 20, 2013, which claims priority of French Patent Application No. 1261083, filed Nov. 21, 2012, the contents of each incorporated herein by reference in their entirety.

FIELD OF THE INVENTION

The invention relates to the field of medium- and high-voltage electricity distribution networks, and in particular to spring control devices for circuit breakers.

Prior Art and Problem Posed

In general, the circuit breakers used in substations are coupled with control devices. Said control devices acquire energy for closing and opening the movable contacts of the circuit breaker via a torque. Those control devices may be hydraulic, pneumatic, or of the spring control type.

When developing spring type control systems, several aspects or criteria are to be considered: operation, performance, possible reduction of costs, reliability, safety, accessibility.

In particular, the need is felt to have available spring control devices available for circuit breakers with a two-period breaking duration. High-voltage circuit breakers, used in electricity networks at 60 Hertz, must react within a short time that is limited to 33.3 milliseconds. In order to protect against faults, at a frequency of 60 Hertz, the speed of movement of the contacts in the circuit breaker needs to be optimized. Recently-developed spring control devices should therefore present increased speed of movement of the movable contacts inside the circuit breaker, without however needing to use springs of the type requiring much greater energy. In addition, the spring control devices that it is desired to develop, should present a lifespan of 40 years, or a number of opening/closing operations of the order of 10000 times.

The document by Max Sardou, entitled "Light weight, low cost, composite coil springs are a reality" SAE 2005, describes the use of different types of composite springs, such as helical springs and C-shaped or Ω-shaped curved springs. Such C-shaped or Ω-shaped springs have been tested in endurance tests.

It may be noted that the advantages of that type of spring include:

- minimum creep;
- high resonant frequency; and
- the possibility of being used in media that are corrosive or polluted to a greater or lesser extent.

In addition, European patent document EP-0 658 909 and French patent document FR-2 840 726 show mechanical spring controls for medium- or high-voltage circuit breakers. In that type of mechanism, the spring is connected to the drive shaft, by means of tensioner devices, such as a chain. Such a chain is fastened to the drive shaft by means of a lever system. In order for each chain to apply torque to the drive shaft, a pulley is used to change the direction of the chain. One of the ends of the spring is mounted on the casing of the device. The other end of the spring may therefore be compressed by the chain. Use is made of a toothed wheel that is driven in rotation by the spring from a first angular position towards a second angular position and of a gear-wheel that co-operates with the toothed wheel. The type of spring used in such a mechanism is a helical type spring. However, that type of spring is relatively heavy and expensive.

Finally, U.S. Pat. No. 7,311,124 shows a method of producing spring wires, including compression springs. That is the type of spring that is used in spring control devices.

There is thus a need for spring control devices for medium- and high-voltage circuit breakers to be fitted with springs other than springs of that type.

SUMMARY OF THE INVENTION

To this end, the invention provides mainly a spring control device for a circuit breaker operating in a high- or medium-voltage network, the device including a drive shaft for enabling very fast actuation of at least one movable contact of the circuit breaker.

According to the invention, the spring is a composite curved spring, that is C-shaped or Ω-shaped.

In the main embodiment of the invention, the spring comprises:

- a first end in the shape of a hook and fastened to a housing of the control device; and
- a second end in the shape of a hook, that is movable, and that is pivotally fastened to a distal end of a lever system that is itself constrained with the drive shaft via its other end.

In the preferred embodiment of the invention, the control device has a housing constituted by two parallel plates between which there is fastened a stationary rod that is fastened to a first end of the spring, the second end of the spring always being placed between the two plates constituting the housing of the device.

LIST OF THE FIGURES

Figure 2:
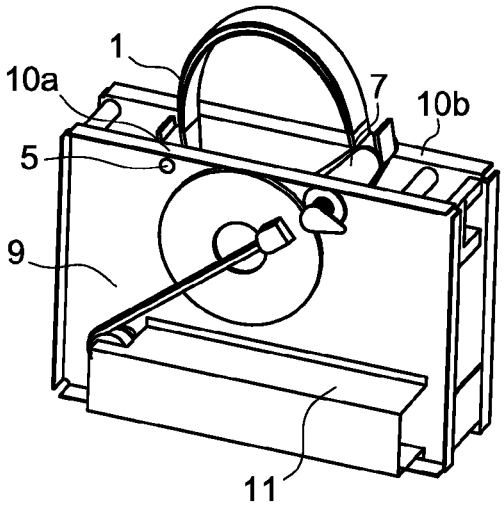

The invention and its various technical characteristics can be better understood on reading the following description, accompanied by two figures in which, respectively:

FIG. 1 is an isometric view of the spring used in the control device of the invention; and FIG. 2 is an isometric view of an embodiment of the control device of the invention.

DETAILED DESCRIPTION OF AN EMBODIMENT OF THE INVENTION

FIG. 1 shows a spring 1 in the shape of the letter C, or in the shape of the Greek letter omega (Ω). According to the invention, said spring is of the composite type. The composite material which is usable for constitute the spring is a material comprising a glass fiber and an epoxy resin matrix. Each of its ends 2 and 3 is hook-shaped. The spring 1 is in the form of a curved blade.

The first end 2 is fastened to a stationary rod 5 that is stationary relative to the housing of the control device. The second hook-shaped end 3 is movable in the sense that its position can vary relative to the stationary rod 5. Thus, the first end 2 of the spring 1 remains in a stationary position.

The second end 3 of the spring 1, which is also hook-shaped, is fastened about a movable rod 4 that is movable in position. This movable rod 4 is placed at the end of a lever system 7, i.e. placed between the two distal ends of two levers 7A and 7B that are parallel. The other ends of these two levers 7A and 7B are fastened to a drive shaft 6, that is notched or fluted, in such a manner as to be capable of being constrained to rotate with said drive shaft.

The spring 1 is loaded in compression. At this stage, the second end 3 of the spring 1 has a first position that is determined relative to the first end 2 of the spring 1. When the spring 1 is suddenly unloaded, i.e. when it relaxes, the second end 3 moves away a little from the first end 2 of the spring 1. In other words, the radius of curvature of the spring 1 increases slightly. In order to better define this deformation, it may be said that the central portion 8 of the spring 1 moves towards a plane defined by the axes of the two rods, the stationary rod 5 and the movable rod 4.

As a result of this relaxing, the movable rod 4 changes position and makes the lever system 7 turn slightly, thus turning the drive shaft 6. Two arrows show the downward movement of the central portion 8 of the spring 1 and the turning of the drive shaft 6. The drive shaft is secured to the lever system 7 by means of a notch system and/or by means of fluting.

With reference to FIG. 2, the spring 1 is inserted in a spring drive device, used for operating high-voltage circuit breakers. Reference may also be made to European patent document EP-0 658 909 that shows such a control device. In this example, the spring 1 is incorporated between the two plates 10A and 10B of the housing of the device, which plates are placed in parallel. The spring 1 is therefore incorporated in part inside the control device.

FIG. 2 shows the stationary rod 5 fastened to the first end 2 of the spring 1 that is placed in stationary manner relative to the two plates 10A and 10B of the housing of the control device. It therefore remains stationary during operation of the spring 1.

The lever system 7 projects from the two plates 10A and 10B, as does the movable rod 4, which is fastened to the second end 3 of the spring 1. The position of the lever device 7 therefore depends on whether or not the spring 1 is loaded.

Because it has not been envisaged to increase the height of the plates 10A and 10B, the spring and the lever device project upwards from the housing of the control device. It could be envisaged to increase the height of the two plates 10A and 10B so that they surround the spring 1 and the lever device 7 entirely.

The spring 1 is therefore used for opening operations of the circuit breaker, and that requires a very high speed of intervention.

Relating to the closing operations of the circuit breaker, a conventional spring is used, in known manner, and is placed inside a box 11, fastened to the housing, on the side of said housing. The closing spring is generally a conventional helical spring.

ADVANTAGES OF THE INVENTION

The invention of a composite spring in a curved C-shape or Ω-shape makes it possible to reduce the mass of the assembly by 10%.

Due to this reduction in mass, the resonant frequency of the spring is increased. Consider the formula below:

$$f \propto \frac{1}{\sqrt{m}}$$

where f is the resonant frequency of the spring and m is the mass of the spring. This may be of great importance when designing the spring control device.

The use of springs of the "composite" type makes it possible to increase the lifespan of the control device. It should be recalled that a "curved" spring of the C-shape or Ω-shape type, and that is of the "composite" type, is capable of surviving load tests of 6 000 000 cycles.

This type of spring presents excellent resistance to creep over time.

Compared to the solution presented in document EP-0 658 909, no chain is used in the control device of the invention to connect the spring that is used to the drive shaft. This minimizes the potential breakdown rate of the assembly.

This type of control device was designed to be fitted to circuit breakers of the gas-insulated switchgear (GIS) type, but it may also be fitted to air-insulated circuit breakers, oil-insulated circuit breakers, or low-oil circuit breakers.

The applications for all of these embodiments are relatively diverse since they concern both outdoor installations and indoor installations.

The invention claimed is:

1. A spring control device for a circuit breaker in a high- or medium-voltage electrical network, the device including a drive shaft (6) for enabling very fast actuation of at least one movable contact of the circuit breaker;

the control device comprising a composite spring having a C-shape or Omega (Ω)-shape, and in that the spring has:

a first end (2) in the shape of a hook and fastened to a housing (10A, 10B) of the control device; and a second end (3) in the shape of a hook that is movable and that is pivotally fastened to a distal end of a lever system (7), the distal end of the lever system being constrained to rotate with the drive shaft (6).

2. A spring control device for a circuit breaker in a high- or medium-voltage electrical network, comprising:

a drive shaft for enabling actuation of at least one movable contact of the circuit breaker;

the control device comprising a composite spring having a C-shape or Omega (Ω)-shape, and having:

a first end in the shape of a hook and fastened to a housing of the control device; and a second end in the shape of a hook that is movable and that is pivotally fastened to a distal end of a lever system, the distal end of the lever system being constrained to rotate with the drive shaft; and a housing having two parallel plates between which there is fastened a stationary rod that is fastened to the first end of the spring, the second end of the spring being movable between the two plates.

* * * * *